US006968668B1

(12) United States Patent
Dimario et al.

(10) Patent No.: US 6,968,668 B1
(45) Date of Patent: Nov. 29, 2005

(54) APPARATUS FOR PACKAGING GOODS IN AN OPEN-BOTTOMED CONTAINER AND METHOD FOR DOING THE SAME

(75) Inventors: Paul E Dimario, Lawrence, MA (US); Francis H Carragher, Pelham, NH (US); James M Hall, Peterborough, NH (US)

(73) Assignee: General Mills, Inc., Minneapolis, MN (US)

( * ) Notice: Subject to any disclaimer, the term of this patent is extended or adjusted under 35 U.S.C. 154(b) by 0 days.

(21) Appl. No.: 09/487,027

(22) Filed: Jan. 19, 2000

(51) Int. Cl.[7] ..... B65B 1/04

(52) U.S. Cl. ..... 53/242; 53/247; 53/284.5; 53/458; 53/468; 53/376.4; 53/491

(58) Field of Search ..... 53/458, 491, 564, 53/242, 247, 284, 284.5, 452, 457, 468, 484, 53/50, 376.4, 377.2, 381.1, 381.2, 381.3

(56) References Cited

U.S. PATENT DOCUMENTS 3,350,836 A * 11/1967 Dillon et al. ..... 53/67
3,605,377 A * 9/1971 Sabel ..... 53/61
3,739,696 A * 6/1973 Pearson ..... 493/178
3,757,486 A * 9/1973 Feurston et al. ..... 53/162
3,854,270 A * 12/1974 Cloud et al. ..... 53/159
4,179,866 A * 12/1979 Graham et al. ..... 53/468
4,550,549 A * 11/1985 Reinfeld et al. ..... 53/447
4,570,421 A * 2/1986 Focke et al. ..... 53/491
5,022,214 A * 6/1991 Kim ..... 53/242
5,044,143 A * 9/1991 Ako et al. ..... 53/448
5,115,625 A * 5/1992 Barbulesco et al. ..... 53/467
5,379,571 A * 1/1995 Gottfreid ..... 53/471

* cited by examiner

*Primary Examiner*—Eugene Kim
*Assistant Examiner*—Christopher Harmon
(74) *Attorney, Agent, or Firm*—Devan V. Padmanabhan; John A. O'Toole; Annette M. Frawley

(57) ABSTRACT

One embodiment of the present invention relates to an apparatus for packaging goods in a box. The apparatus comprises a box erecting apparatus for erecting the box to receive at least one good. The apparatus further comprises an elevator lift apparatus operatively positioned below the box erecting apparatus, such that the elevator lift apparatus is positioned to lift at least one good into the erected box.

12 Claims, 13 Drawing Sheets

APPARATUS FOR PACKAGING GOODS IN AN OPEN-BOTTOMED CONTAINER AND METHOD FOR DOING THE SAME

TECHNICAL FIELD

This invention relates to the packaging of goods. More specifically, this invention relates to a method and apparatus of packaging goods in open-bottomed containers.

BACKGROUND

Packaging goods in containers for shipment was originally done by hand. Packaging by hand requires a person to unfold a container to be used, pack it, and then seal it for shipment. Automation replaces manual activities for more and more of these different packaging jobs, saving both time and money.

The packaging of containers has been automated at every stage of the packaging process. For example, if the containers are cardboard boxes, different machines can unfold them, place them in position to load them, load them, and seal them as well. Unfortunately, separate machines cost more money and take up more space on the production floor. The packaging of goods has numerous problems including cost, ease of operation, and speed.

The machines used for packaging are not only expensive to purchase they are expensive to operate. Operating expenses are first increased by the size of the machines. Current machines are up to ten feet long just for the container-unfolding portion. All of the equipment to unfold a cardboard box container, package it with goods, and seal it can exceed 34 feet in length. A large footprint that takes up a lot of room on the production floor means a larger facility needs to be built and maintained, or less equipment must be utilized.

Another problem with prior art packaging operations is that the operations are complex. As mentioned above, several separate machines are required to do each job in the packaging operation. First, equipment must be utilized to fold the box. Once the box has been folded, it must then be packaged by a separate machine. Once the box is packaged, it must finally be sealed by even another machine. Having been sealed the container is then finally ready for shipment. Designing a machine that does one or more of these jobs simultaneously, and in a small space, would be a great benefit to the cost and simplicity of the packaging operation.

Costs can also be incurred because of the way the boxes are un-packaged by the customer who receives them. When the containers, for example cardboard boxes, reach the customer, a person often manually unloads the container. Once the palette is unloaded, the containers themselves must be opened. One problem with cardboard box containers is that they are often opened with a case cutter or other sharp implement. These sharp tools can damage the goods contained therein. As a remedy to this problem, open-bottomed containers can instead be used. These containers utilize the surface of the palette upon which it is resting, or the top of the container below it, to replace having a bottom. When the goods are needed, a person simply lifts off the container to get at the goods contained inside.

An apparatus and method is needed for performing all of the above functions. It is further required that the apparatus and method performs compactly, cheaply, and quickly. Having a simple machine will further lower production costs and reduce the amount of equipment that is on the production floor.

SUMMARY

One embodiment of the present invention relates to an apparatus for packaging goods in a box. The apparatus comprises a box erecting apparatus for erecting the box to receive at least one good. The apparatus further comprises an elevator lift apparatus operatively positioned below the box erecting apparatus, such that the elevator lift apparatus is positioned to lift at least one good into the erected box.

Another embodiment of the present invention relates to an apparatus for packaging goods in an open-bottomed container. The apparatus comprises an elevator lift apparatus for lifting at least one good through a bottom of the open-bottomed container and a support mechanism which is operatively positioned relative to the elevator lift apparatus for supporting the at least one good in the open-bottomed container.

A further embodiment of the present invention relates to a method of packaging goods in a box, the method comprising actuating an elevator lift apparatus to raise the goods into the box and supporting the goods in the box after the elevator lift apparatus is lowered.

A final embodiment of the present invention is a method for delivering goods comprising transporting goods packaged in open-bottomed containers on a palette whereby the goods may be accessed by lifting the open-bottomed container.

DETAILED DESCRIPTION

Machine Overview

Figure 1:
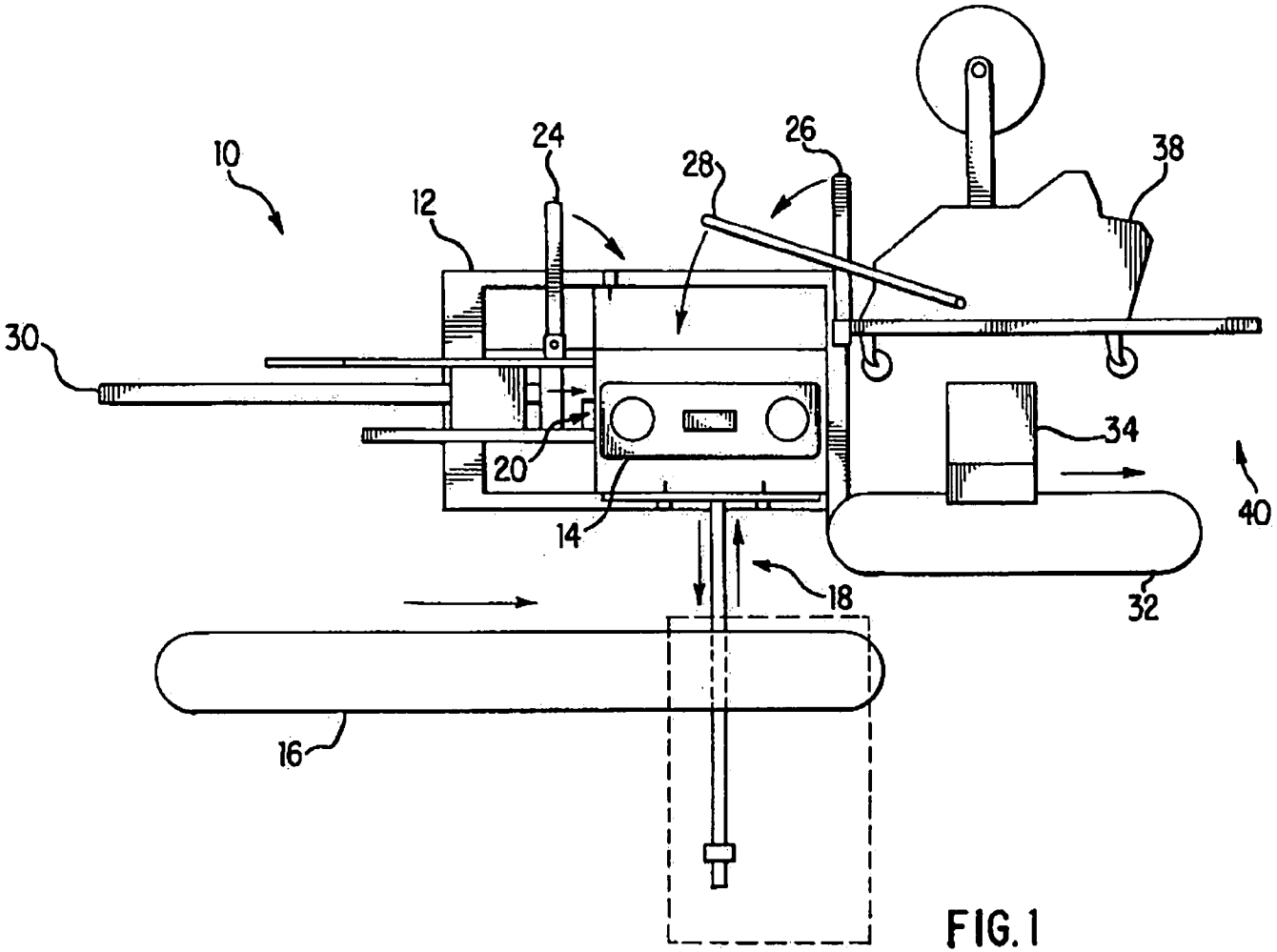
FIG. 1 shows a perspective view of the packaging system as seen from the operator side of the invention.

With reference to FIG. 1, an embodiment of the packaging machine 10 of the present invention will be described. As shown in FIG. 1, a packaging machine 10 comprises a box magazine 12, a box erector apparatus 14, a first conveyor 16, an elevator lift apparatus 18, guide/support mechanisms 20 and 22, short flap-folding mechanisms 24 and 26, a long flap-folding mechanism 28, a box out-feed pusher 30, a second conveyor 32, a sealing mechanism 38, and a labeling mechanism 34. The box erector apparatus 14 is positioned so that the open-bottomed container 42 is erected directly over the elevator lift apparatus 18. The first conveyor 16 is positioned to deliver goods to the elevator lift apparatus 18. The goods 44 on the elevator lift apparatus 18 are lifted into the erected container from the bottom. The guide/support mechanisms 20 and 22 are positioned to facilitate the goods 44 being lifted into the open-bottomed container 42 and to support the goods once they are loaded into the open-bottomed container 42. Short flap-folding mechanisms 24 and 26 and the long flap-folding mechanism 28 then fold the top flaps of the open-bottomed container 42 closed.

The box out-feed pusher 30 then pushes the loaded open-bottomed container 42 containing the goods 44 onto the second conveyor 32. The second conveyor 32 is adapted to receive the container 42 with the goods 44 from the area of the box erector apparatus 14. The second conveyor 32 transports the containers to the sealing mechanism 38 and labeling mechanism 34. After the open-bottomed containers 42 are past the second conveyor 32 they may be manually loaded onto a palette. The parts of the present invention herein described utilize air-powered cylinders to actuate movement. However, the air-powered cylinders for any of the parts could be replaced by any other means known in the art to perform the movements necessary.

The packaging machine 10 of the present invention provides a compact, bottom loading packaging machine that packages goods in an open-bottomed container. In the preferred embodiment the footprint of the machine is approximately four feet by five feet. Other embodiments of the present invention may have different dimensions. For instance, one embodiment has a four inch wider frame for larger case sizes, another has a machine width that is approximately fourteen inches narrower. Additionally, a further embodiment has an increased width of two inches, but still has the same overall machine length.

The preferred embodiment herein described utilizes a box made of cardboard. However, any box or container may be used with the apparatus and method of the present invention. Also, in the preferred embodiment, the cardboard box 42 that is used has an open-bottom. In this embodiment a flat-folded cardboard box 42 is erected by the machine of the present invention 10 into an open-bottomed cardboard box 42 (see FIGS. 3A and 3B). Though the preferred embodiment incorporates an open-bottomed cardboard box as the container, any type of box compatible with the present invention can be utilized.

In one embodiment, the dimensions of the unfolded cardboard box may be 11.5 inches in width, 19 inches in length, and 7.75 inches in height. The goods that are packed in this container may include two cases measuring 9.5 inches in width, 11.5 inches in length, and 7.75 inches in height. The goods to be packaged preferably are of a shape that they will be able to ride the first conveyor 16, touching both the left conveyor belt 132 and right conveyor belt 134 (see FIG. 4). Further, as will be discussed later, the goods must also be of a shape that will properly work in conjunction with the guide/supporting mechanisms 20 and 22 described below. It is understood, however, that the following description is relevant to any type of open-bottomed container 42 compatible with this invention.

The Box Magazine

Figure 2:
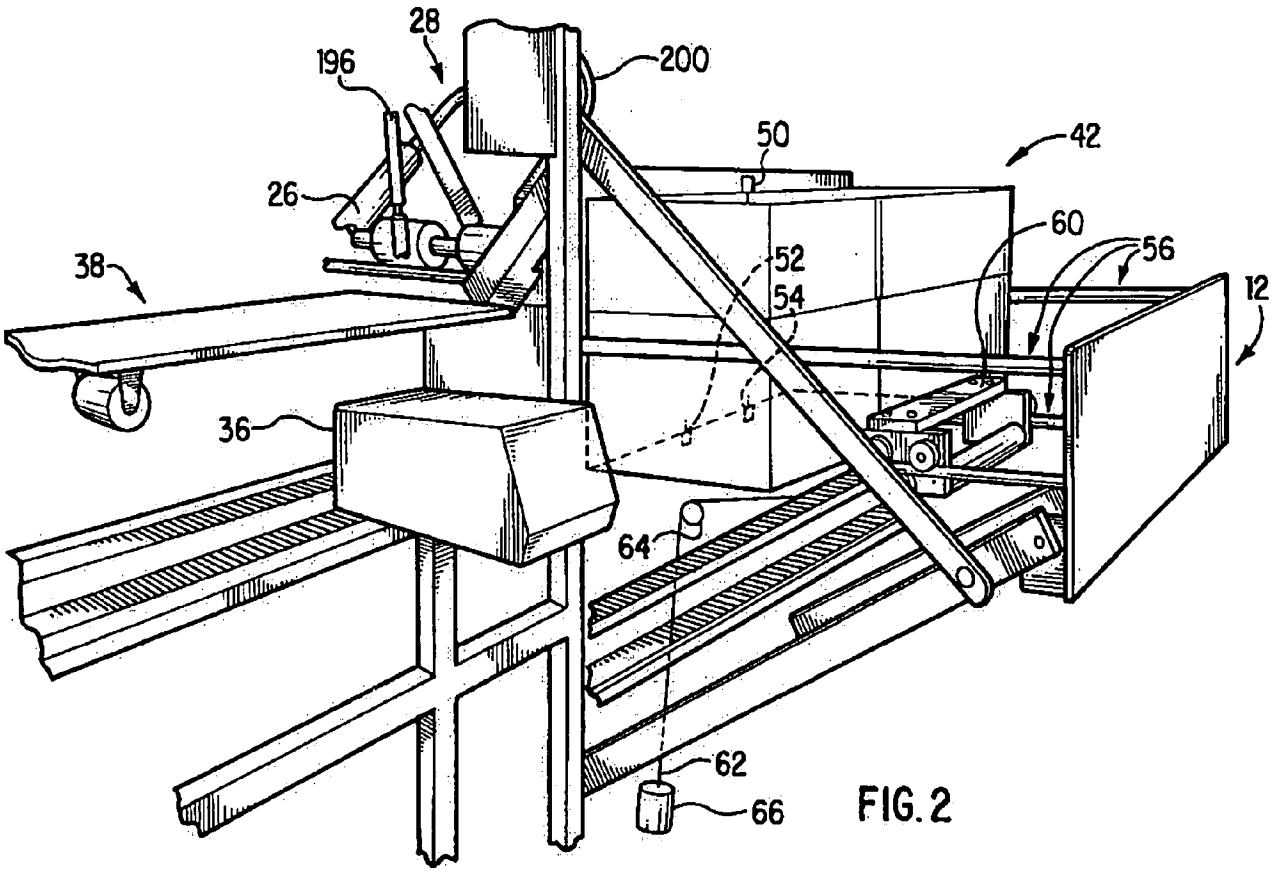
FIG. 2 is a perspective view from the non-operator side showing the machine from the end of the second conveyor.

As shown in FIGS. 2 and 3, a flat-folded cardboard box magazine 12 comprises an upper magazine pin 50 and lower magazine pins 52 and 54 that may be used to hold the flat-folded cardboard box 42 in position. As shown in FIG. 2, the flat-folded cardboard box magazine 12 further comprises several support bars 56 on which the flat-folded cardboard boxes 42 are positioned, and an apparatus for insuring the proper positioning of the loaded flat-folded cardboard boxes 42. The flat-folded cardboard box magazine 12 is situated in such a way as to present the flat-folded cardboard boxes 42 in the proper position to be opened by the box erector apparatus 14. As shown in FIG. 2, the support bars 56 are positioned above and to the sides of the flat-folded cardboard boxes 42 to bracket the same and hold them in place.

Figure 3A:
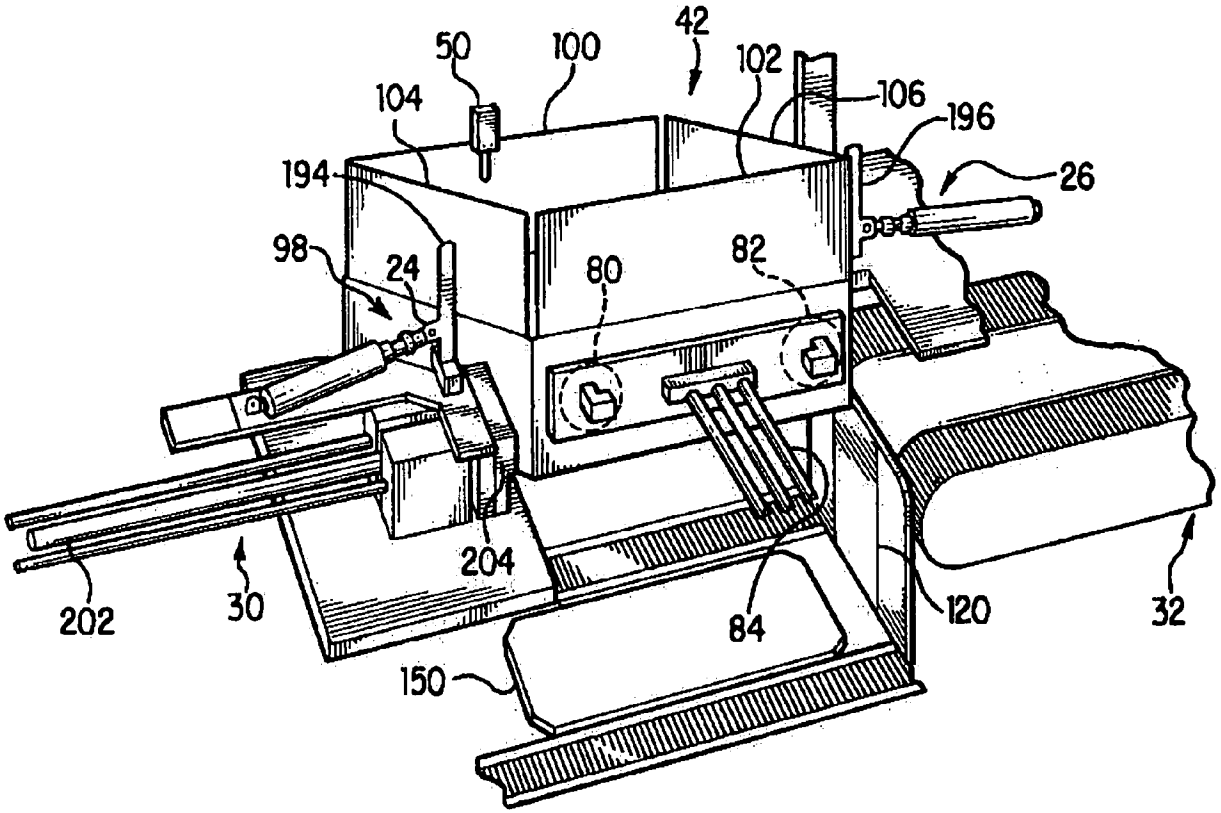
FIGS. 3A, 3B, 3C and 3D are perspective views from over the top the machine showing in detail the cardboard box erecting mechanism.
Figure 3B:
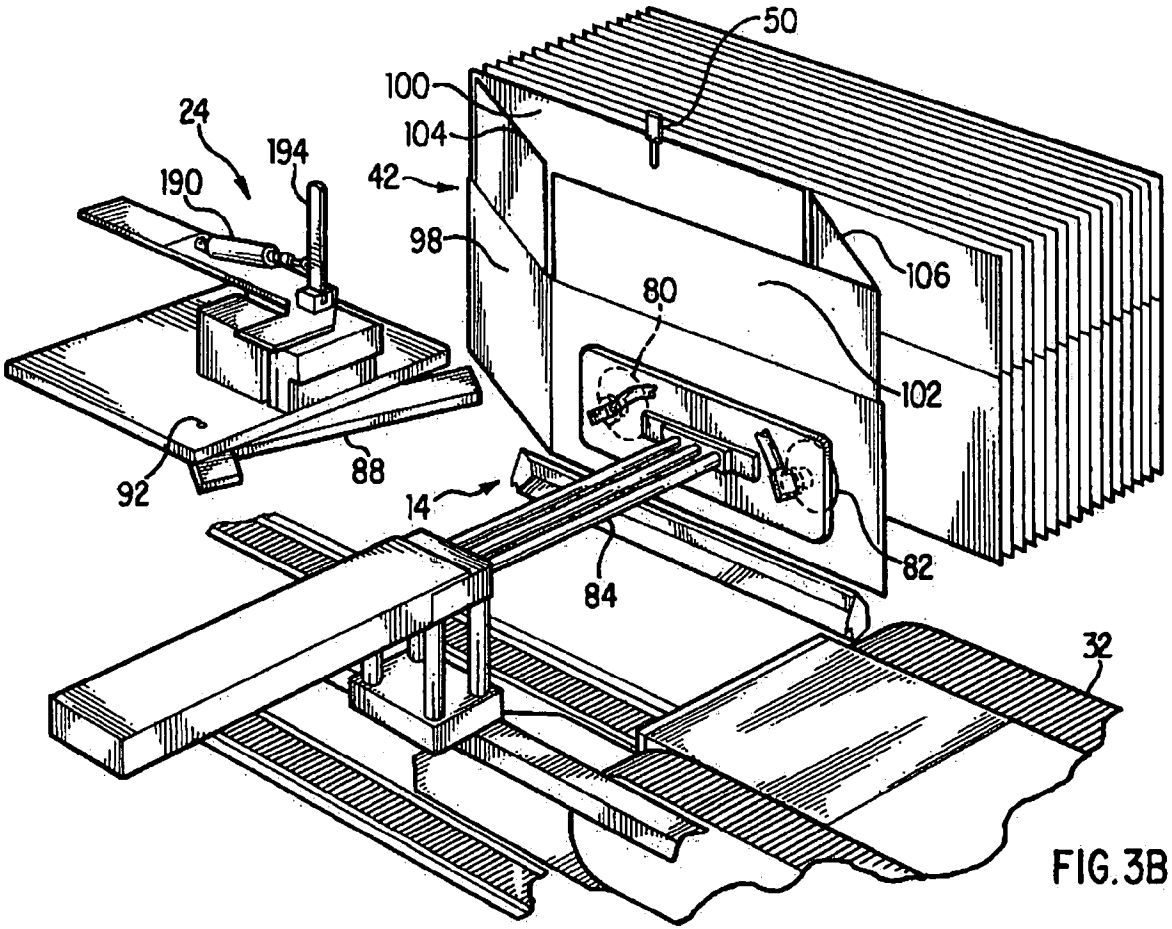

Referring to FIGS. 3A and 3B, the flat-folded cardboard boxes 42 are positioned on the flat-folded cardboard box magazine 12 in such a way that when the box erector moves suction cups 80 and 82, the suction cups 80 and 82 are in a position where they can attach against the flat-folded cardboard box 42. The flat-folded cardboard boxes 42 are maintained so that one is continuously presented for the box erector apparatus 14 to grab and unfold. The flat-folded cardboard boxes are further secured into the proper position by magazine pins 57 and 58. However, other methods known to those skilled in the art may also be used.

FIG. 2 shows how, in the preferred embodiment, a wheeled mechanism 60 insures that the flat-folded cardboard boxes 42 are presented in the correct position to be opened by the box erector apparatus 14. The wheeled mechanism 60 is suspended upon the support bars 56 of the magazine and abuts the last flat-folded cardboard box 42. This wheeled mechanism 60 is hooked to a wire 62, which goes through a pulley 64 and is attached to a weight 66 suspended below the flat-folded cardboard box magazine 12. The weight 66 pulls on the wire 62 which in turn pulls on the wheeled mechanism 60. The wheeled mechanism 60 then puts pressure on the stack of flat-folded cardboard boxes 42, keeping the same presented in the correct position to the unfolding by the box erector apparatus 14. Correct positioning of the flat-folded cardboard boxes 42 could also be accomplished by other means known in the art. An example of these other means may include a powered magazine feed system.

The Box Erector

As shown in FIGS. 3A, 3B, 3C, and 3D, the box erector apparatus 14 comprises the attached suction cups 80 and 82, the box erector cylinder 84, the shape guide 86, and the popping mechanism 88. The popping mechanism 64 further comprises a popper pivot point 92, a popper long end 94, and a popper short end 96. In this embodiment the box erector apparatus 14, including the box erector cylinder 84, the suction cups 80 and 82, and the shape guide 86 are operatively attached to the first conveyor 16. The popping mechanism 88 is positioned relative to the shape guide 86 and the first conveyor 16.

In operation, the box erector apparatus' 14 attached suction cups 80 and 82 are moved across the gap above the elevator lift plate 150 by the box erector cylinder 84 (FIGS. 3A and 3B). The box erector cylinder 84 is attached to the operator side of the box erector apparatus 14. In this embodiment, the cylinder 84 is powered by air pressure, but the cylinder 84 can be powered by other means well known in the art. In FIG. 3A the suction cups 80 and 82 come into contact with the box and begin to retract. The box erector cylinder 84 then retracts the suction cups 80 and 82 and begins drawing the flat-folded cardboard box 42 across the area above the elevator lift plate 150. FIGS. 3A and 3B show the box erector cylinder 84 beginning to retract. The flat-folded cardboard box 42 forms the shape of a rhombus. The trailing side of the flat-folded cardboard box 98 is anchored to the flat-folded box magazine 12 by an upper magazine pin 50 and a lower magazine pins 52 and 54 connected to the flat-folded cardboard box magazine 12. As the cylinder 84 finishes retracting the suction cups 80 and 82, two other parts of the box erector apparatus insure that the box takes the proper shape.

Figure 3C:
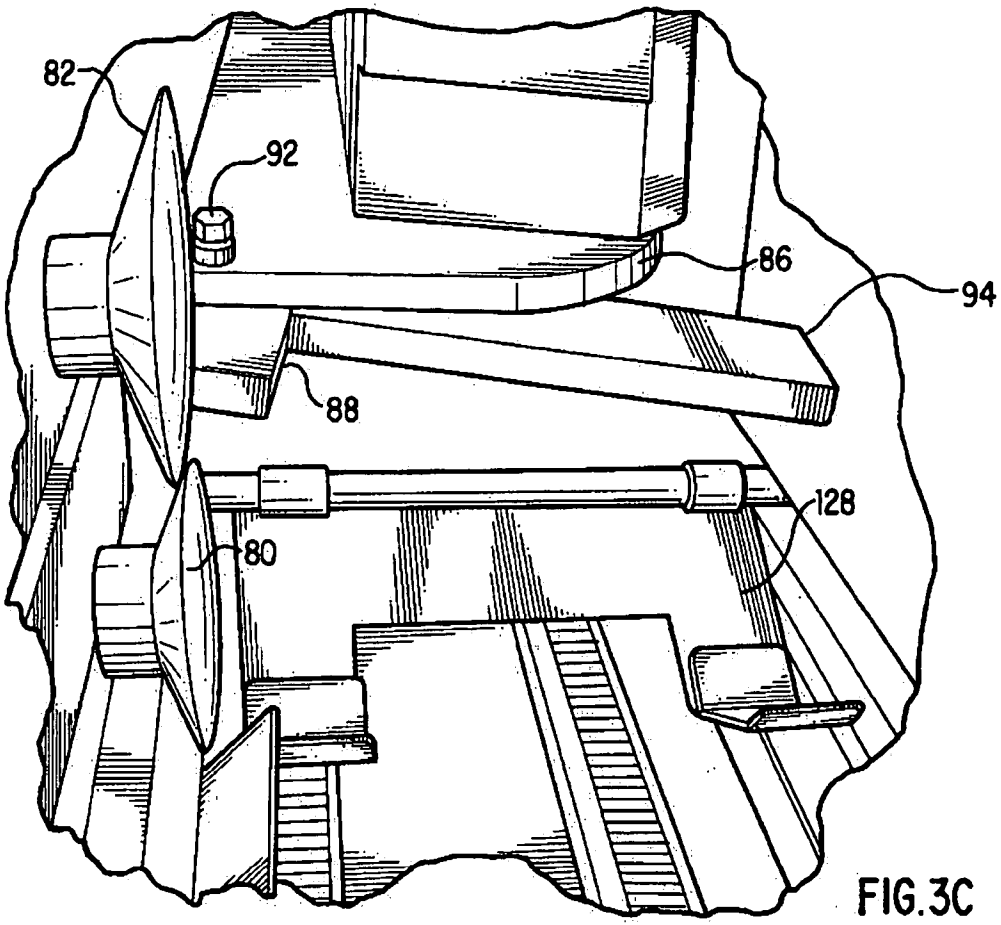

The shape guide 86 see in FIG. 3C aids the box erector apparatus 14 to unfold and form the cardboard box 42 in a small area. The shape guide 86 may be made out of plastic, or any other stiff substance known in the art. The shape guide 86 is operatively connected to the first conveyor 16 and the popping mechanism 88. The cardboard box trailing edge 98 of the flat-folded cardboard box 42 comes into contact with the curved surface of the shape guide 86. As the flat-folded cardboard box 42 is dragged across the opening above the elevator lift apparatus (FIG. 3A), the curved shape of the shape guide 86 pushes the trailing edge 98 of the flat-folded cardboard box 42, causing the flat-folded cardboard box 42 to take on a more rectangular shape.

Figure 3D:
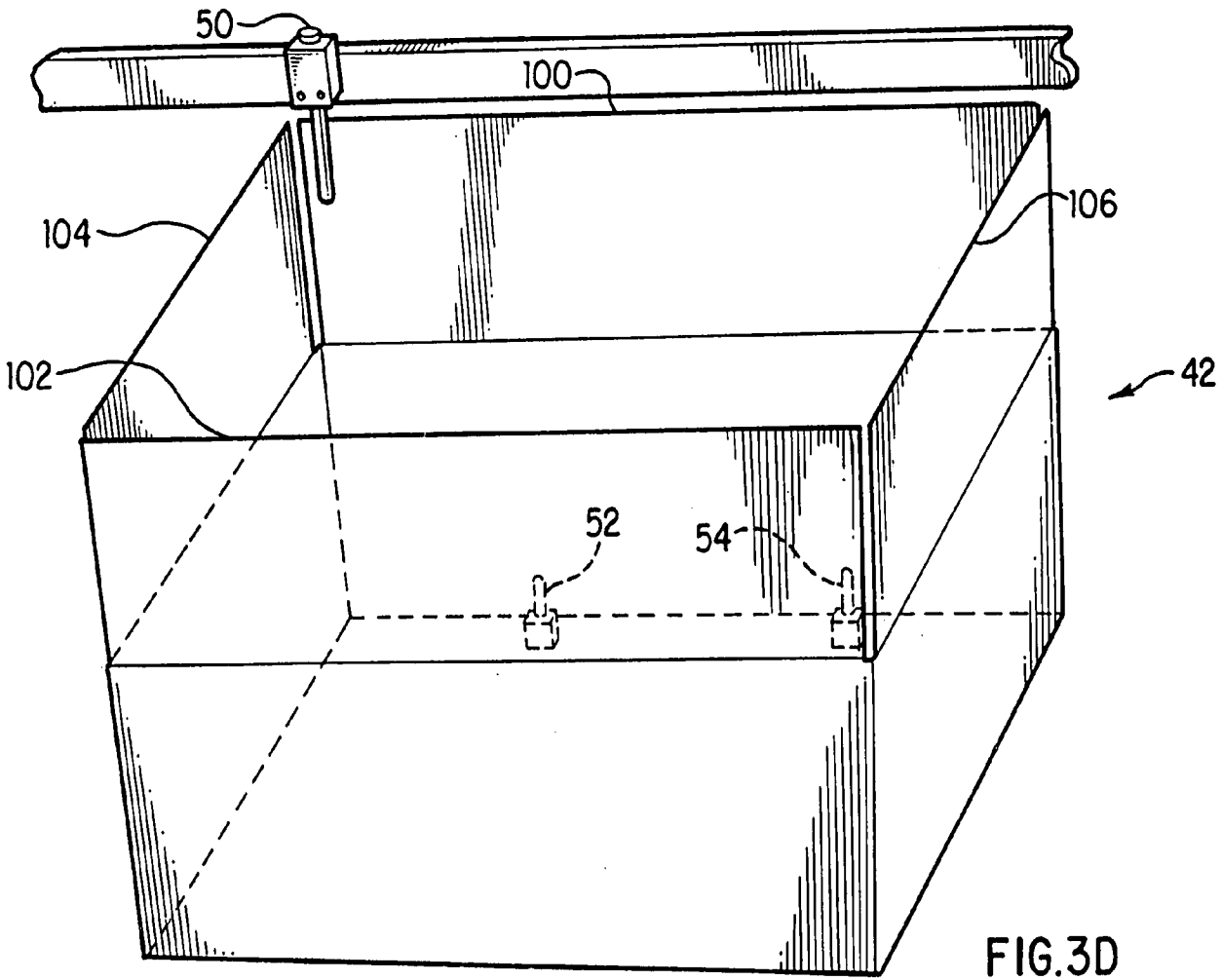

At this point in the process a popping mechanism 88 "kicks" the cardboard box 42 to further insure the cardboard box 42 takes the proper rectangular shape. As seen in FIG. 3C, the popping mechanism has a long end 94 and a short end 96 on each side of the popping mechanism 88 popper pivot point 92. The popper long end 94 swings around the popper pivot point 92 to contact the trailing edge 98 of the flat-folded cardboard box 46. The position of the popping mechanism shown in FIG. 3C is as it would appear after "kicking" the cardboard box. The ready position is with the long end 94 rotated back underneath the shape guide 86. The popping mechanism 88 kick helps to complete the formation of the flat-folded cardboard box 42 into a rectangular cardboard box 42 as shown in FIG. 3D. The popper mechanism 88 in this embodiment is powered by a spring, but could be powered by any means known in the art.

As the box erector cylinder 84 completes its retraction cycle, the upper magazine pin 50 that was anchoring the side of the cardboard box fits through the natural break between the long flap 100 and the short flap 104 of the cardboard box 42 (FIG. 3D). The box also comes off of the lower magazine pins 52 and 54 located on the bottom of the cardboard box magazine. In this way, the cardboard box 42 is unfolded into its correct shape, resting in a position above the elevator lift apparatus 18 and ready to accept the goods 44 when they are raised by the elevator lift apparatus 18.

One advantage of this invention is that the box is unfolded into the proper shape in one step and in one small area. The box erector apparatus 14, including the shape guide 86 and popping mechanism 88, opens the flat-folded cardboard box 42 in the area just over the elevator lift apparatus 18. As mentioned above, this is the same area in which the goods 44 will be loaded into the just formed cardboard box 42.

Another of the advantages of this invention is that the box erector apparatus 14 erects the open-bottomed containers in the exact position where the goods 44 will be loaded. There is no need to transport the open-bottomed container after it has been erected, rather the goods 44 can be loaded into the open-bottomed container 42 right after it is erected. Unfolding and loading in the same place speeds the process by eliminating transport steps; this also helps to reduce on the size of the machine.

The First Conveyor

Figure 4:
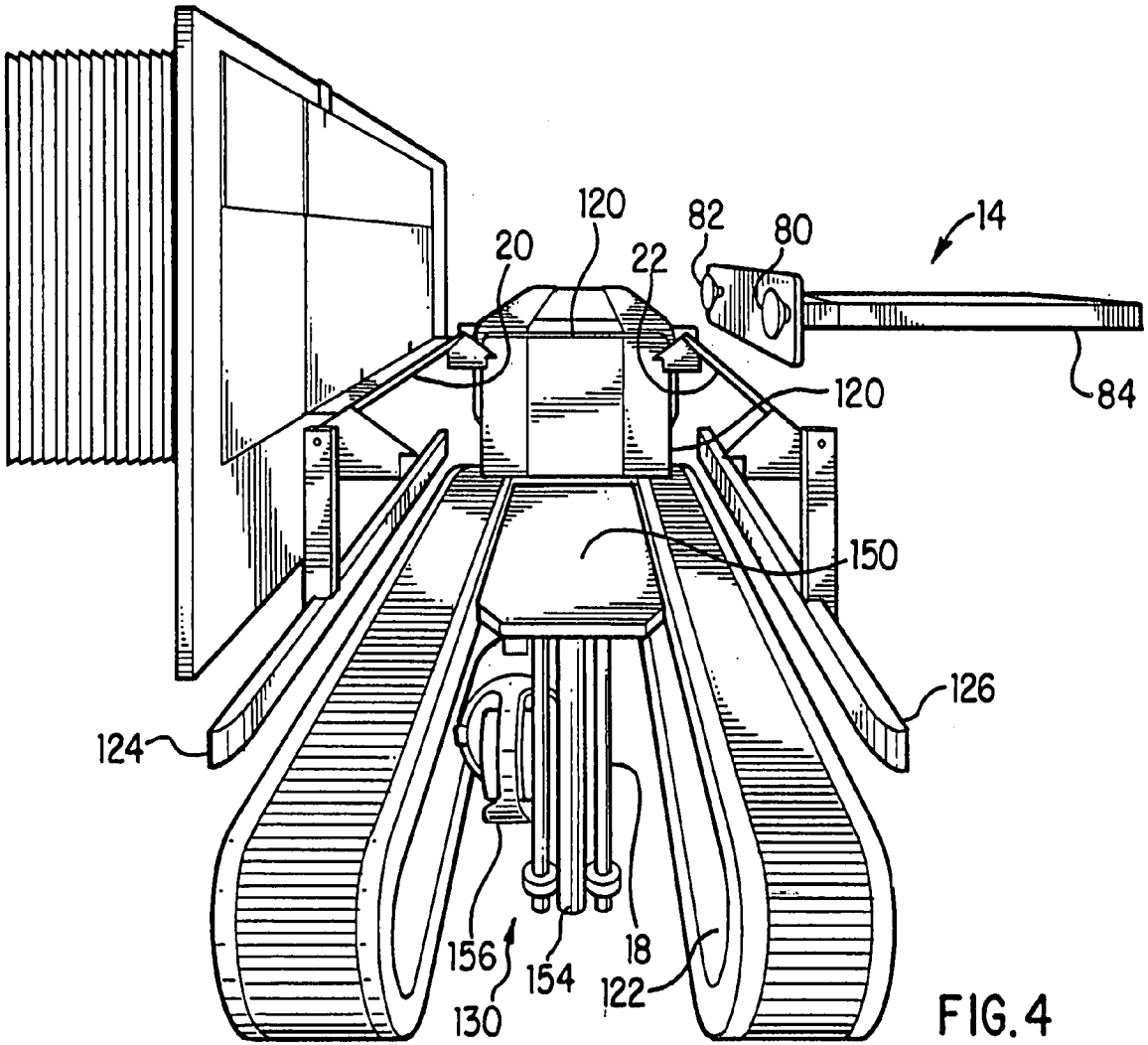
FIG. 4 is a perspective view looking down the first conveyor mechanism.

As shown in FIG. 4, the first conveyor 16 comprises a stopping block 120, a first guide bar 124, and a second guide bar 126. The first conveyor 16 further comprises an open space 130 formed by a left conveyor belt 132 and a right conveyor belt 134. The first guide bar 124 and second guide bar 126 are operatively connected over the top of the left conveyor belt 132 and right conveyor belt 134. The stopping block 120 is operatively connected to the downstream end of the first conveyor 16.

The goods 44 to be packaged in the container 42 are placed on the first conveyor 16. The first conveyor 16 moves the goods 44 until they come into contact with the stopping block 120. The stopping block 120 stops the movement of the goods 44 such that the goods 44 are positioned directly over the elevator lift apparatus 18. The first and second guide bars 124 and 126 insure that the goods 44 do not fall off the left conveyor belt 132 and right conveyor belt 134 when they are moving along the first conveyor 16. The upper guide 128 (FIG. 3C) also insures proper movement of the goods 44 along the first conveyor 16.

The Elevator Lift Apparatus

As shown in FIG. 4, the elevator lift apparatus 18 comprises an elevator lift plate 150, an elevator lift plate base 152 (see FIG. 5*a*), and an elevator lift column 154. The elevator lift apparatus 18 may be positioned between the left conveyor belt 132 and the right conveyor belt 134, just before the stopping block 120. The bottom of the elevator lift plate 150, the elevator lift plate base 152, is operatively attached to the top of the elevator lift column 154. The bottom of the elevator lift column 154 is attached to a mechanism 156 for moving the elevator lift column 154, and the elevator lift plate 150, from a down position to an up position.

Figure 5A:
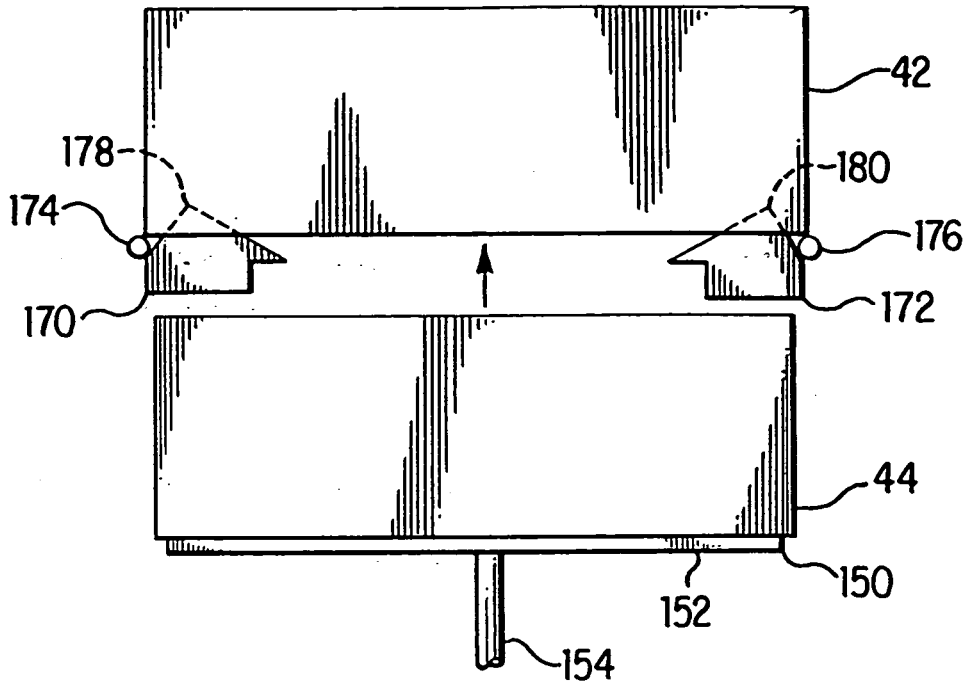
FIGS. 5*a*, 5*b* and 5*c* are perspective views showing the loading of the goods into the container and the operation of the guide/support mechanisms.
Figure 5B:
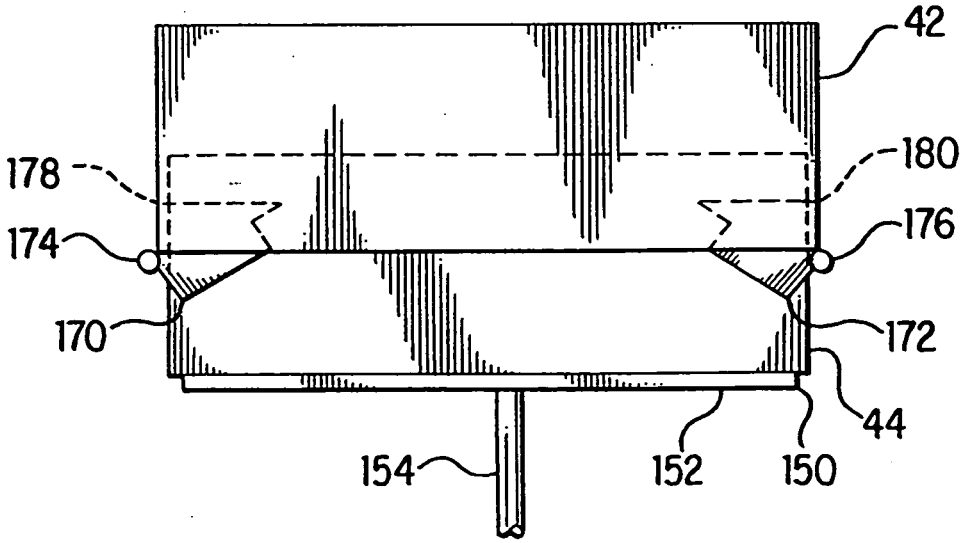

Once the proper amount of goods 44 are in place over the top of the elevator lift apparatus 18, the elevator lift plate 150 moves from a down position to an up position by the action of the elevator lift column 154. FIG. 4 shows the elevator lift apparatus 18 in the down position. In this embodiment, the elevator lift column 154 is actuated by an air compressor, but can be driven by any means known to those skilled in the art. When the elevator lift plate 150 is lifted, the goods 44 are moved up towards the cardboard box 42. The elevator lift apparatus 18 lifts the goods 44 into and through the bottom of the cardboard box 42. As shown in FIGS. 5*a* and 5*b*, the elevator lift plate 150 fits between the guide/support mechanisms 20 and 22. While the goods 44 are lifted, they come into contact with the guide/support mechanisms 20 and 22 which are positioned over the left conveyor belt 132 and right conveyor belt 134 of the first conveyor 16. The elevator lift plate 150 is designed with a dimension that insures that it can fit between the rest position of the guide/support mechanisms 20 and 22 without coming into contact with the same. After the elevator lift column pushes the elevator lift plate 150 to its up position, the elevator lift column 154 retracts the elevator lift plate 150 back to its original down position. After the elevator lift plate 150 reaches its original down position it is ready to lift the next set of goods 44 to be packaged.

The Guide/Support Mechanisms

As shown in FIGS. 4 and 5*a*, 5*b*, and 5*c*, the guide/support mechanisms 20 and 22 comprise a bottom edge 170 and 172, a rotational pivot point 174 and 176, and a top edge 178 and 180. The guide/support mechanisms 20 and 22 are operatively attached to the first conveyor 16 in a position so that they rest above and to either side of the elevator lift apparatus 18. In this embodiment the guide/support mechanisms 20 and 22 have an interior width between them defined by the distance between the top edges of the guides 178 and 180. The guide/support mechanisms 20 and 22 also have an exterior width that is defined by the bottom edges of the guides 170 and 172. The guide/support mechanisms 20 and 22 each further have a rotational pivot point 174 and 176. Each guide may be able to rotate the interior top edge 178 and 180 upwards and outwards. However, the guide/support mechanisms 20 and 22 may not rotate the top edge 178 and 180 downwards. In this embodiment the guide/support mechanisms 20 and 22 are long flat rectangular shapes with another flat portion angled at a 90° bookend to the long position. (Shown in FIG. 5*a*). The long flat portion is what the goods 44 contact and push open.

In this embodiment the guide/support mechanisms 20 and 22 are placed in a position so that the width of the goods 44, as measured perpendicular to the direction of motion, is wider than the interior width defined by the top edges 178 and 180. The width of the goods 44 must be additionally smaller than the width between the rotational pivot points 174 and 176 (FIG. 5*a*). As the guide/support mechanisms 20 and 22 pivot at each pivot point, the top edges 178 and 180 of each guide/support mechanism 20 and 22 rotate in an upward and outward arc. As shown in FIG. 5*b*, when the guide/support mechanisms 20 and 22 rotate, the top edges 178 and 180 come into contact with the interior of the cardboard box 42. This funnel action insures that the goods 44 are lifted cleanly into the cardboard box 42, by preventing the goods 44 from binding against the bottom edges of the cardboard box 42. As the elevator lift apparatus 18 continues to rise, the goods 44 clear the top edges 178 and 180 of the guide/support mechanisms 20 and 22, allowing the guide/support mechanisms 20 and 22 to fall back into their original angled position (FIG. 5*c*).

Figure 5C:
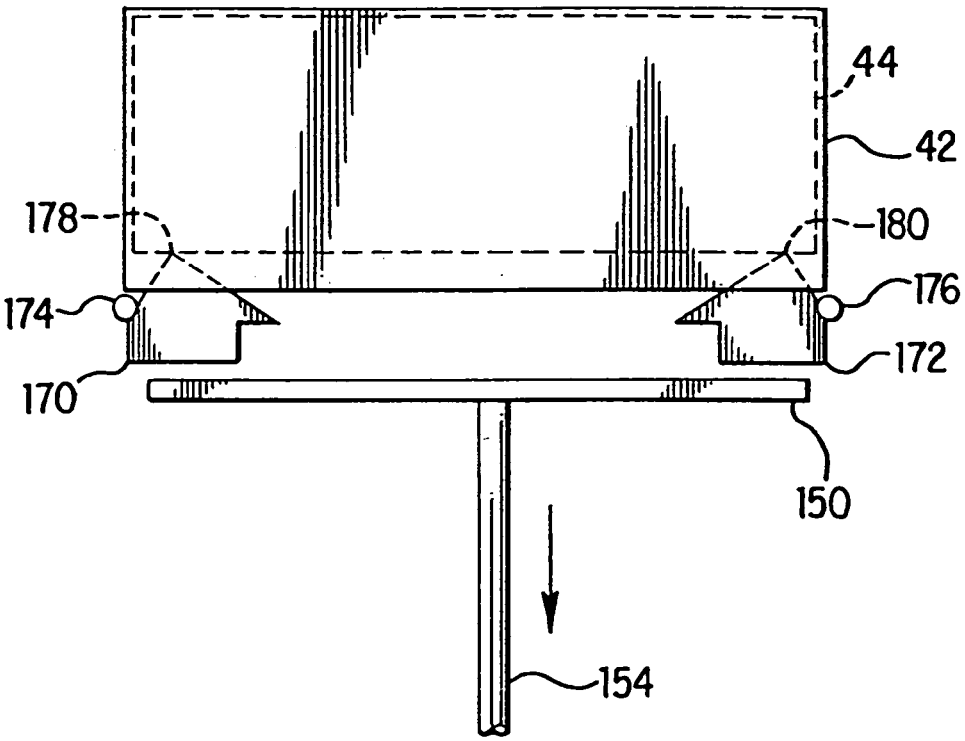

FIG. 5*c* shows the goods after the elevator lift apparatus 18 has lifted the goods 44 inside of the cardboard box 42. When the goods are inside the cardboard box 42, the elevator lift plate 150 connected to the top of the elevator lift apparatus 18 now begins to descend back to its down position. The elevator lift plate 150 fits back in between the guide/support mechanisms 20 and 22. As the goods 44 come into contact with the top edges 178 and 180 of the guide/support mechanisms 20 and 22, the goods 44 come to a rest on top of the guide/support mechanisms 20 and 22 (FIG. 5*c*). The guide/support mechanisms 20 and 22 support the weight of the goods 44 because the guide/support mechanisms 20 and 22 are designed so that the top edges 178 and 180 do not rotate downwards past their rest position. The goods 44 rest on the support/guide mechanisms 20 and 22 inside the cardboard box 42.

Several more advantages of this invention are present in the act of lifting the goods 44 into the open-bottomed container. First, the duality of function of the guide/support mechanisms 20 and 22 is an advantage. The guide/support mechanisms 20 and 22 act as the funnel to insure that the goods 44 do not bind up against the side of the box. The guide/support mechanisms 20 and 22 also serve as the support upon which the cardboard box 42 and goods 44 rest after loading. This multi-tasking saves space and lowers cost. Furthermore, this versatility enables the goods 44 to be guided into the open-bottomed container, the guides to be removed, and then the goods 44 to be supported in a very short time frame with a great economy of movement.

Another advantage is that the cardboard box 42 is loaded in the same place that the cardboard box 42 is erected. The suction cups 80 and 82 used by the box erector 92 to start the opening of the preferred embodiment's flat-folded cardboard box 42 are still attached to the cardboard box 42 as it is packaged with the goods 44. These suction cups 80 and 82 serve to stabilize the box so that it does not shift as the goods 44 are raised by the elevator lift plate 150 and guided by the guide/support mechanisms 20 and 22 into the bottom of the cardboard box 42.

The Flap-Folding Mechanisms

Figure 6:
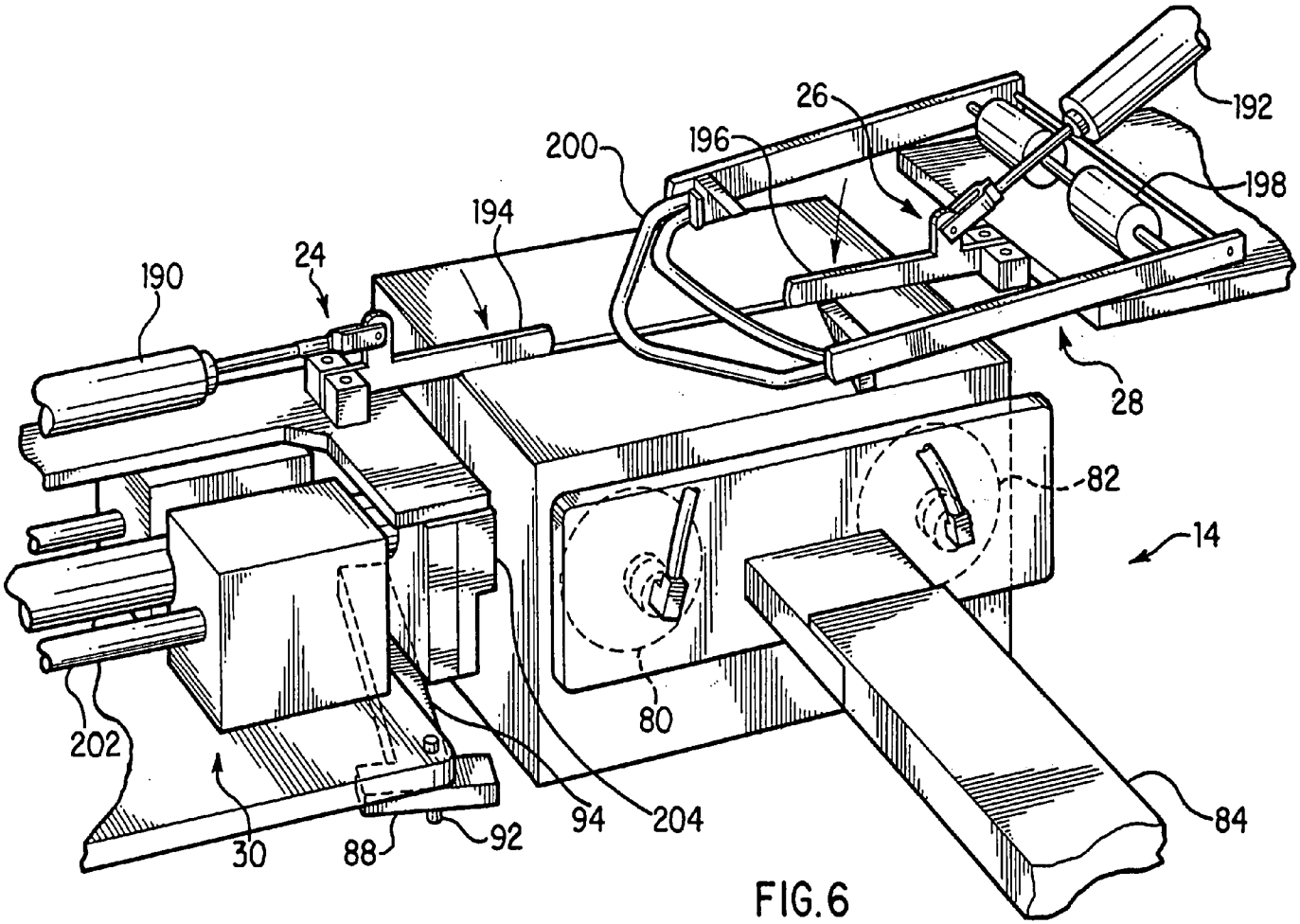
FIG. 6 is a perspective view of the three flap-folding devices.

As is shown in FIG. 6, the short flap-folding mechanisms 24 and 26 comprise two flap-folding cylinders 190 and 192 and two flap-folding fingers 194 and 196. The long flap-folding mechanism 28 comprises a long flap-folding cylinder 198 and a U-shaped bar 200. All of the flap-folding mechanisms are attached above the cardboard box 42 and either upstream (24) or downstream (26 and 28) of the elevator lift apparatus 18. In this embodiment, the short flap-folding cylinders 190 and 192 and the long flap-folding cylinder 198 are all powered by air pressure. Other mechanical means can be substituted by those skilled in the art. FIG. 6 shows a view from the top of the cardboard box 42. The elevator lift apparatus 18 has just raised the goods up through the bottom of the cardboard box 42, and the goods 44 are now resting on top of the guide/support mechanisms 20 and 22. The suction cups 80 and 82 can be seen as still in contact with the side of the cardboard box 42. The two short flap-folding mechanisms 24 and 26 can be seen as well as the long flap-folding mechanism 28. The box out-feed pusher 30 is also shown.

At this step in the process, the short flap-folding cylinders 190 and 192 of the short flap-folding mechanisms 24 and 26 move the short flap-folding fingers 194 and 196. The short flap-folding cylinders 190 and 192 are connected in such a way that their movement causes the short flap-folding fingers 194 and 196 to pivot on their base in an arc and come into contact with the short flaps 104 and 106 of the cardboard box 42. This contact causes the short flaps 104 and 106 of the cardboard box 42 to be pushed into the down position. The short flap-folding fingers 194 and 196 continue to stay in the down position, holding the short flaps 104 and 106 folded.

The long flaps 100 and 102 are now folded by the U-shaped bar 200 of the long flap-folding mechanism 28. The long flap-folding cylinder 198 actuates the U-shaped bar 200 causing it to rotate in a downward arc over its base. The U-shaped bar 200 simultaneously contacts both of the long flaps 100 and 102. This contact forces the long flaps 100 and 102 down on top of the two short flaps 104 and 106 that are already folded. The short flap-folding mechanisms 24 and 26 are placed in such a position that the long flaps 100 and 102 do not come to rest on top of the short flap-folding fingers 194 and 196 which are still in the down position.

The three flap-folding mechanisms 24, 26, and 28 represent a clear advantage. The loaded open-bottomed container does not need to be moved to have the flaps folded. As mentioned above, the open-bottomed container 42 is unfolded in exactly the right position to be loaded. This same loading position is also the one used when the flap-folding occurs, economizing movement and shortening the overall operation. The present embodiment incorporates three flap-folding mechanisms because of the nature of the flat-folded cardboard box shape. Other containers might incorporate a different number of flap-folding mechanisms depending on the configuration of the container.

The Box Out-Feed Pusher

As shown in FIGS. 1, 3A, and 6, the box out-feed pusher 30 comprises a box out-feed cylinder 202 and a box out-feed cylinder head 204. The box out-feed pusher 30 is operatively connected over the first conveyor 16 and next to the guide/support mechanisms 20 and 22 so that the box out-feed cylinder head 204 can contact the cardboard box 42.

After all of the flaps have been folded, the box out-feed pusher 30 extends. When the box out-feed pusher 30 extends the box folding mechanisms 24, 26 and 28 move back to their original positions to wait for the next box. As the box out-feed pusher 30 extends it pushes both the cardboard box 42, and the goods 44 inside of it, towards the second conveyor 32. The goods 44 inside of the cardboard box 42 move smoothly over the top the guide/support mechanisms 20 and 22. The second conveyor 32 catches the cardboard box container 42 and the goods 44 and moves them downstream towards the sealing mechanism 38 and labeling mechanisms 34 and 36.

The Sealing and Labeling Mechanisms

Figure 7:
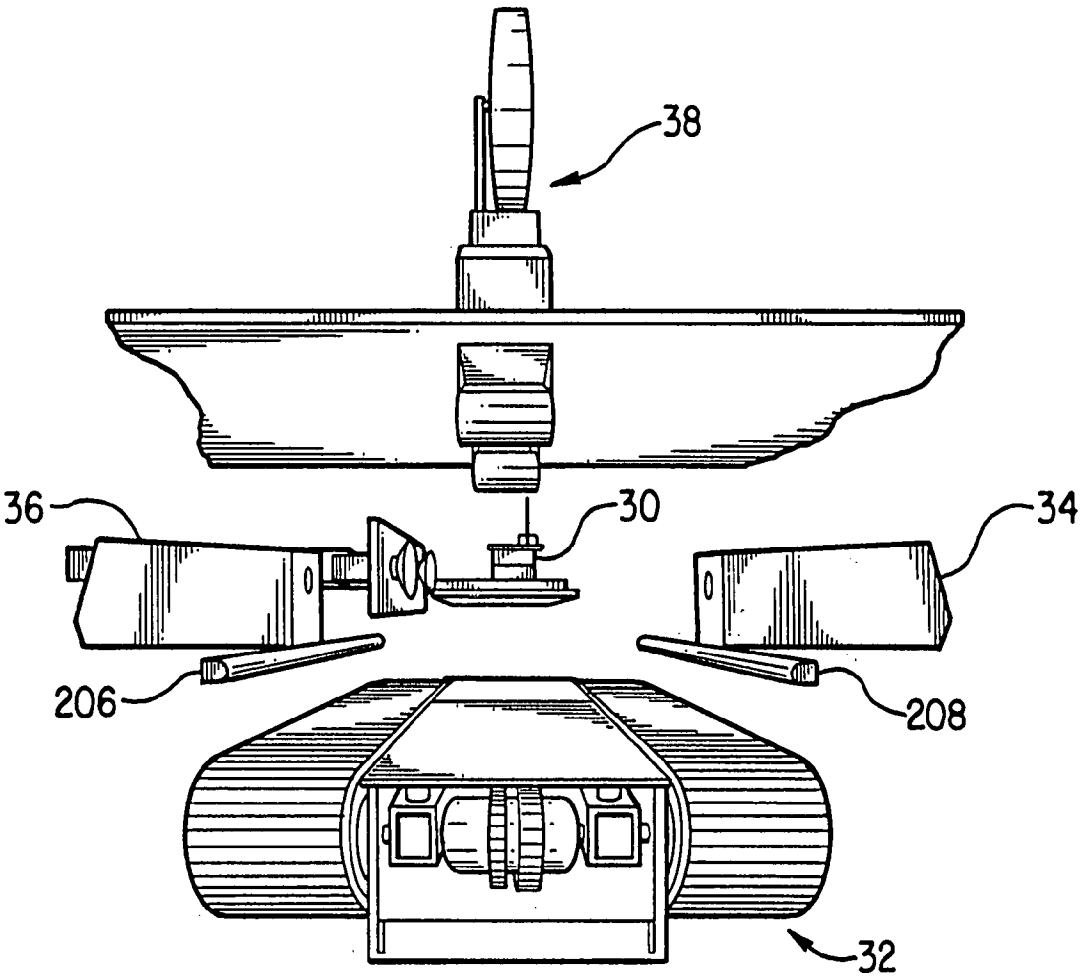
FIG. 7 is a perspective view that looks back upstream along the second conveyor towards where the goods originate.

As is shown in FIG. 7, the sealing mechanism comprises a standard sealing mechanism 38 operatively connected above the second conveyor 32. The labeling mechanisms 34 and 36 comprise units which are operatively attached to either side of the second conveyor 32. As is shown in FIG. 7, the third and fourth guide bars 206 and 208 are operatively connected over top of the second conveyor 32.

In this embodiment, the loaded cardboard box 42 and the goods 44 are pushed onto the second conveyor 32 by the box out-feed pusher 30 as described above. The second conveyor 32 moves the cardboard box 42 underneath the sealing mechanism 38 and in between the two labeling mechanisms 34 and 36. An improvement of this machine is the ability to label and seal the machine in one step. The sealing mechanism 38 and labeling mechanisms 34 and 36 work almost simultaneously upon the loaded cardboard box 42. Because of the concurrent action, the cardboard box 42 is labeled and sealed in a quick and efficient manner.

In this embodiment, the sealing mechanism 38 is a taping machine. A taping machine is particularly adapted for working on the type of cardboard box 42 used in this embodiment. The taping machine 38 runs one continuous piece of tape starting on the leading side of the cardboard box 42, over the top of the folded flaps of the box, and then part of the way down the trailing edge 98. Other types of sealers known in the art, such as a hot glue device, could likewise be incorporated into the machine.

On the left and right side are the two labeling mechanisms 34 and 36. In this embodiment, the labeling mechanisms 34 and 36 are inkjet printers mounted so that they print on the side of the cardboard box 42 as it is moved on the second conveyor 32. Other labeling devices could be substituted.

The third and fourth guide bars 206 and 208 are operatively connected above and to the sides of the second conveyor 32 and perform much in the same way as the first and second guide bars 124 and 126. As the cardboard box 42, loaded with the goods 44 moves along the second conveyor 32, the third and fourth guide bars 206 and 208 come into contact with the sides of the cardboard box 42 to insure that the cardboard box 42 does not fall off the side of the second conveyor 32. When the goods 44 and the cardboard box 42 reach the end of the second conveyor 32, the operator picks up the items. The operator may stack the packaged container on a palette or deal with them in any manner so desired.

The Method of Operation

Figure 8:
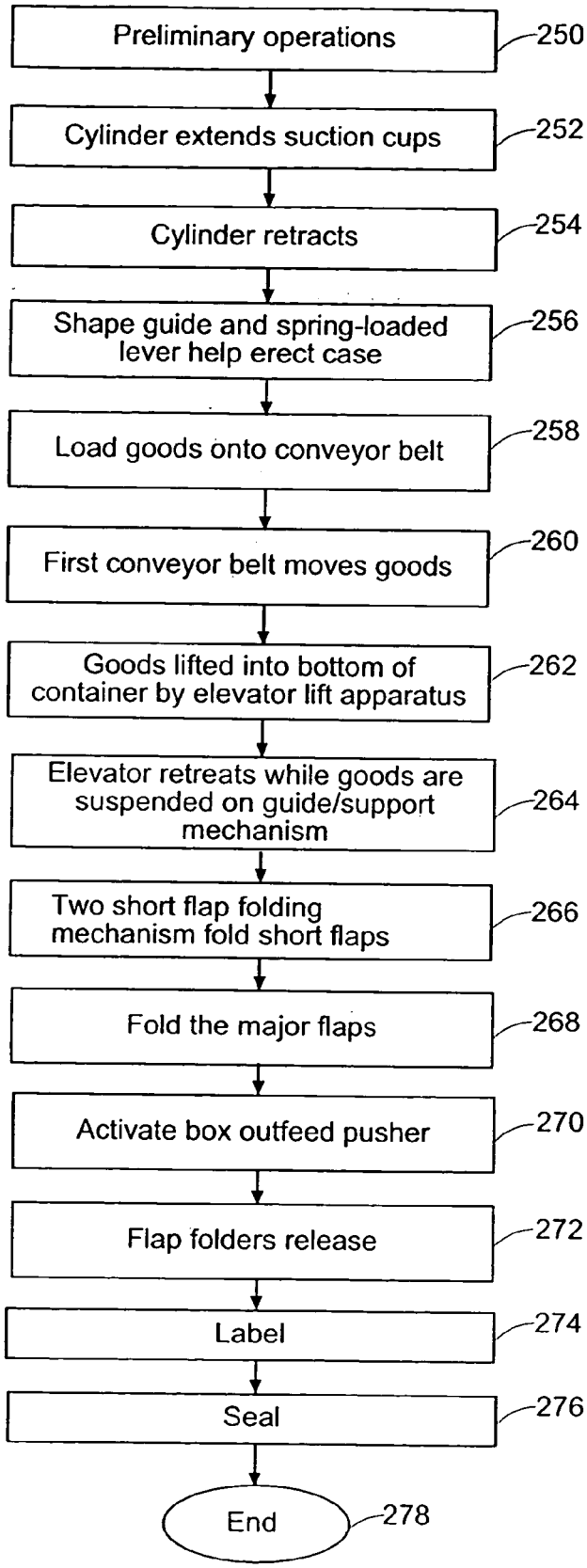
FIG. 8 is a block diagram of the method.
Figure 9:
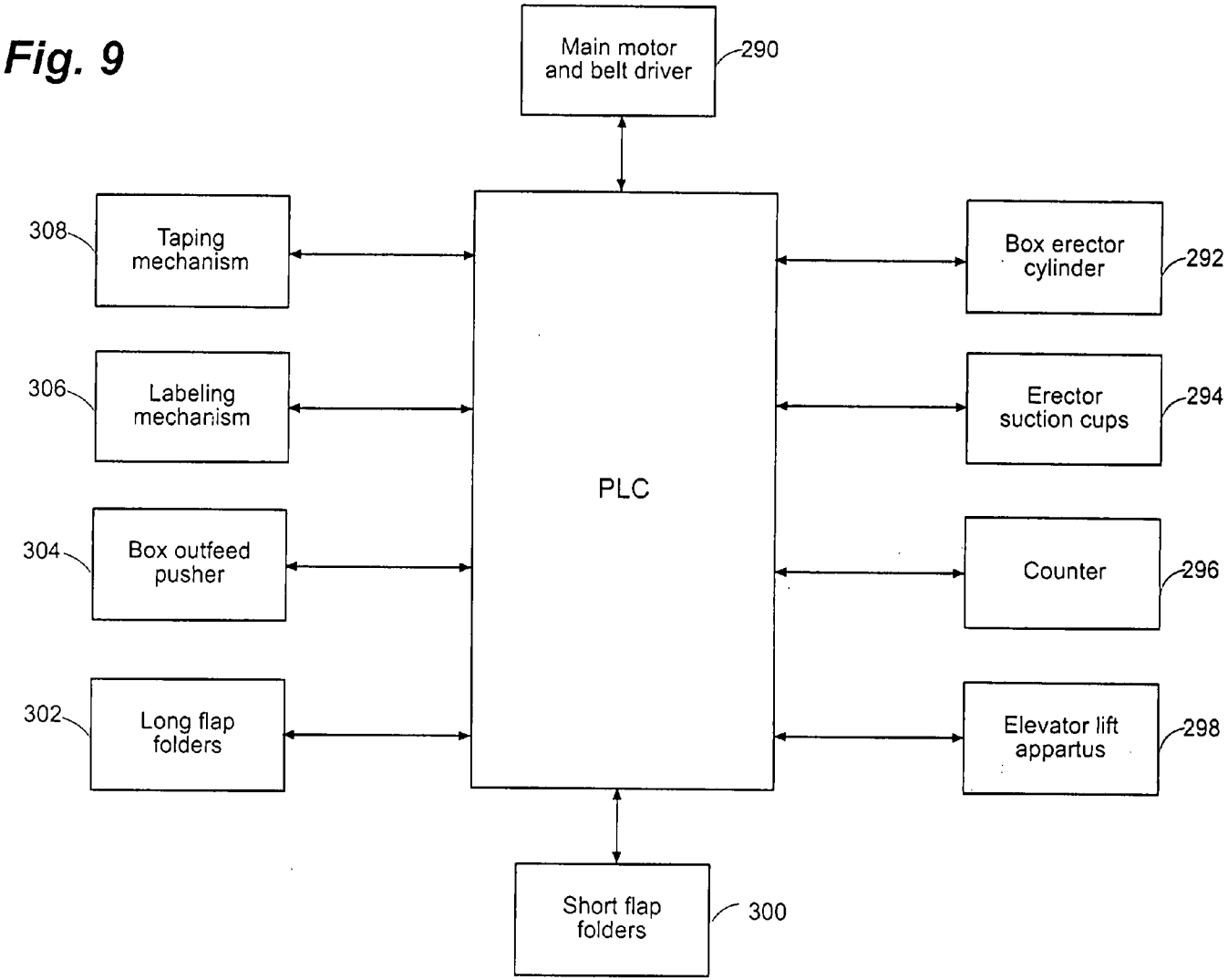
FIG. 9 is a block diagram of the operating system.

FIG. 8 is a block diagram showing the method of operation of the invention. This invention has several operations that are performed in a simultaneous fashion. Each operation will be described as a separate action independent of the others that are concurrently running. The last figure, FIG. 9, shows a block diagram of the interconnectivity of the various elements attached to and controlled by the Program Logic Control ("PLC"). The PLC is the central processing unit and programming platform that controls the operation of this invention. The following describes the method incorporating the commands of the PLC. These acts are described in terms of the embodiment that utilizes an open-bottomed container as the box and air pressure as the means for moving the different cylinders which actuate most of the mechanisms of the invention; both of these can be substituted with other means known in the art.

Before the machine can begin the automatic unfolding, loading, and sealing of the open-bottomed containers, the operator must insure that the magazine is filled with the proper type of container to be used (block 250). In this embodiment open-bottomed cardboard boxes are used.

As shown in FIG. 9, the PLC is connected to the main power motor of the invention 290. The PLC is also connected to box erector cylinder 292, the erector suction cup vacuum 294, the various counters 296, the elevator lift apparatus 298, the short flap-folding mechanisms 300, the long flap folding mechanism 302, the box out-feed pusher 304, the labeling mechanisms 306, and the taping mechanism 308.

When the operator turns on the PLC it starts the main motor. Power is then fed to the different motors and moving parts of the machine. The belt drive of the first and second conveyors starts and runs continuously. In this embodiment the taping machine may also be activated and run continuously.

This first act is the unfolding of the container. The container is opened in a position above the elevator lift plate and ready to accept the goods to be packaged. In this embodiment of the invention, the shape of the box is rectangular and orientated so that the long part of the rectangle lays in the direction of conveyor operation. The open-bottomed container could be orientated in different ways and the container itself could be a different shape. In FIG. 8, block 252, the PLC first commands the cylinder for the box erector to extend. As the cylinder is extending, the PLC activates the vacuum pump that is connected to the two suction cups. When the cylinder is extended, it causes the suction cups to come into contact with the flat-folded cardboard box. The PLC causes the extended cylinder to pause for an instant so that the suction cups can seat themselves and stick to the flat-folded cardboard box. The PLC then retracts the box erector cylinder (block 254). In order to open the container in such a small area, actions of a shape guide and a popper mechanism aid the box erector to insure the container will form the proper shape (block 256).

Once the open-bottomed container is properly formed (at blocks 254 and 256), the goods are placed on the first conveyor (block 258) and move towards the elevator lift apparatus (block 260). The goods pass through an upper guide and past a counting mechanism. The upper guide insures that the goods are properly orientated when they hit the stopping block. Counting insures that the proper number of goods come to rest in front of the stopping block and over the top of the elevator lift apparatus before the goods are raised into the open-bottomed container.

In this embodiment a photoelectric eye connected to the PLC does the counting (FIG. 9, block 296). This photoelectric-eye sensor counts the goods to be packaged as they pass by on the first conveyor. When the proper number is counted and the cardboard box has been unfolded, the PLC commands the elevator lift apparatus to lift the goods into the bottom of the now open-bottomed cardboard box (block 262).

Once the correct number of goods reaches the stopping block in the correct orientation, the elevator lift apparatus raises the goods into the open-bottomed container (block 262). The lifting motion can be performed by any number of methods known to one skilled in the art. The goods are guided into the box by two guide/support mechanisms to prevent fouling. In this embodiment, these guides are strictly mechanical in nature and are not connected to the PLC. These guide/support mechanisms are designed in such a way that the upper edge of the goods being raised into the box can not catch and foul the bottom edge of the open-bottomed container.

The elevator lift apparatus continues to lift the goods until the lower edge of the goods clears the top edge of the guide/support mechanisms. At this point the guide/support mechanisms snap back down into their rest position (block 264). After the elevator lift plate lifts the goods to the elevator lift apparatus' highest level, the PLC will command the lift plate to start to move back to its lower position (block 264). The guide/support mechanisms are placed at such a width that the elevator lift plate can fit between them at the angled rest position.

As the elevator lift plate lowers, the elevator lift plate fits between the two guide/support mechanisms. The goods, however, catch on the top edge of the guide/support mechanisms and come to a rest. As the goods rest on the guide/support mechanisms they remain inside of the open-bottomed container (block 264). The elevator lift plate continues back to its lowest position and awaits the arrival of more goods to lift into the next properly positioned open-bottomed container.

At this point the upper flaps of the open-bottomed container are folded. First, the two smaller flaps are folded by the action of two separate devices (block 266). Each device has a cylinder positioned above and at each end of the open-bottomed container. The PLC activates the cylinders powering these flap-folders. These individual cylinders move in a downward arc, contacting each one of the smaller flaps, pushing them until they come to rest in a roughly horizontal plane. These two cylinders remain in this position, holding down the two smaller flaps while the larger two flaps are folded. The PLC commands the same type of air cylinder to move the U-shaped long flap-folding mechanism as it did for the short flap-folding mechanism. The long flap-folding mechanism in this embodiment is in the form of a U-shaped bar. At the command of the PLC (block 268), the long U-shaped bar rotates down in an arc, contacting both of the long cardboard box flaps and folding them until they are horizontal. The PLC leaves all three of these flap-folding mechanisms in place until the box out-feed pusher has been activated. The flap-folding mechanisms in this embodiment are air powered, but any way of moving the devices known in the art would suffice.

Once the flaps are properly folded, the box out-feed pusher acts to drive the open-bottomed cardboard box onto the second conveyor (block 270). After the PLC has commanded the three flap-folding devices to each perform their function, the PLC instructs the box out-feed pusher to push the loaded open-bottomed container onto the second conveyor. When the out-feed pusher has extended to its furthest point, the PLC causes the same to return back to its original position. As the second conveyor starts to move the open-bottomed container, the PLC commands the three separate box folding mechanisms to move back into their up positions (block 272).

The second conveyor now moves the open-bottomed cardboard box through the last step in the packaging operation. As the second conveyor moves the open-bottomed cardboard box loaded with the goods, the open-bottomed cardboard box passes by the two labeling mechanisms positioned on opposite sides of the conveyor belt (block 274). In this embodiment, the two labeling mechanisms are standard inkjet printers that automatically print on the box as it goes by, with no connection to the PLC necessary. In addition, the folded top flaps of the container are sealed (block 276). In this embodiment a standard taping device known to those in the art seals the flaps. The open-bottomed cardboard container, with the goods inside, then reaches the end of the second conveyor, and the end of the machine (block 278). While the sealing and taping is going on for one box, the PLC is opening another box over the elevator lift plate to receive more goods from the first conveyor.

When the open-bottomed container reaches the end of the machine, the open-bottomed container may be stacked on a palette for delivery to a customer. In one embodiment, the open-bottomed container packaged with goods are stacked on a palette and transported to a customer. It should be noted that in order to access these goods, the open-bottomed container need not be cut open. Rather, the goods may be accessed by simply lifting the open-bottomed container.

Although the description of this machine and the present embodiment has been quite specific, it is contemplated that various deviations can be made to this embodiment without deviating from the scope of the present invention. Accordingly, it is intended that the scope of the present invention be dictated by the appended claims rather than by the foregoing description of this embodiment.

What is claimed is:

1. An apparatus for packaging goods in a box erected from a flat-folded configuration to receive at least one good, the box having first and second sidewalls that define a bottom opening, the apparatus comprising:

(a) a box erecting apparatus for erecting the box from a flat-folded configuration, the box erecting apparatus comprising a first device adapted to contact the first sidewall and a second device adapted to contact the second sidewall, wherein the second device is displaceable from a first position, which is adjacent to the first device, to a second position, thereby unfolding the box;

(b) an elevator lift apparatus operatively connected below the box erecting apparatus, the elevator lift apparatus having a third position, a fourth position, and an axis of movement such that when the elevator lift apparatus lifts the at least one good from the third position to the fourth position, the at least one good passes through the bottom opening, into the box, and between the first device and the second device in the second position; and (c) a support mechanism operably positioned relative to the box erecting apparatus wherein the support mechanism directly contacts and receives the at least one good after the elevator lifts the at least one good to the fourth position, the support mechanism supporting the at least one good substantially over the top of the elevator lift apparatus as the elevator lift apparatus returns to the third position to then receive another good to be moved to the fourth position.

2. The apparatus of claim 1, wherein the support mechanism contacts the at least one good during at least a portion of its displacement to the fourth position.

3. The apparatus of claim 1, further comprising a finishing apparatus for sealing the box, wherein the finishing apparatus is operatively connected to the box erecting apparatus.

4. The apparatus of claim 3, further comprising a magazine for storing boxes adapted to be erected by the box erecting apparatus.

5. The apparatus of claim 4, further comprising a labeling apparatus operatively connected to the finishing apparatus.

6. The apparatus of claim 5, further comprising a first conveyor defining a first conveyor plane positioned to deliver goods to the elevator lift apparatus.

7. The apparatus of claim 6, further comprising a second conveyor defining a second conveyor plane positioned to transport the goods through the finishing and labeling apparatuses.

8. The apparatus of claim 7, wherein the box erecting apparatus comprises at least one suction cup.

9. A method for packaging goods in a box having first and second sidewalls that define a bottom opening, the method comprising:

(a) presenting the first sidewall to a first device as the box is in a flat-folded configuration and the second sidewall is attached to a second device;

(b) attaching the first device to the first sidewall;

(c) unfolding the box by moving the first device to a displaced position away from the second device;

(d) activating an elevator lift apparatus to raise an at least one good from a first position up to a second position within the box, the elevator lift apparatus having an axis of movement such that when the elevator lift apparatus lifts the at least one good from the first position to the second position, the at least one good passes through the bottom opening, into the box, and between the second device and the first device in the displaced position; and (e) supporting the at least one good via direct contact between a support member and the at least one good in a position substantially over the top of the elevator lift apparatus while the elevator lift apparatus returns to the first position to then receive at least another good to be moved to the second position.

10. The apparatus of claim 9, wherein the support member contacts the at least one good during at least a portion of its displacement to the second position.

11. The apparatus of claim 1, wherein the support mechanism comprises a guide position for guiding the at least one good into the bottom opening of the box.

12. The apparatus of claim 11 wherein the support mechanism further comprises a support position for supporting the goods while the elevator returns to the third position.

* * * * *